United States Patent [19]

Svyatsky

[11] Patent Number: 4,928,952

[45] Date of Patent: May 29, 1990

[54] MECHANICAL DOCUMENT FEED APPARATUS

[75] Inventor: Eduard Svyatsky, Chicago, Ill.

[73] Assignee: Bell & Howell Co., Chicago, Ill.

[21] Appl. No.: 109,491

[22] Filed: Oct. 16, 1987

[51] Int. Cl.[5] ..... B65H 1/02

[52] U.S. Cl. ..... 271/150

[58] Field of Search ..... 271/160, 149, 150, 31.1, 271/129, 149, 150, 160

[56] References Cited

U.S. PATENT DOCUMENTS

| | | | |
|---|---|---|---|
| 2,021,648 | 11/1935 | Dickermann | 271/129 |
| 3,598,400 | 8/1971 | Nelson | 271/150 |
| 3,966,193 | 6/1976 | Storace | 271/150 |
| 4,094,441 | 6/1978 | Warren | 271/31.1 A |
| 4,323,230 | 4/1982 | Rising | 271/150 X |
| 4,328,962 | 5/1982 | Akers | 271/31.1 X |
| 4,662,623 | 5/1987 | Nakanishi | 271/160 X |

FOREIGN PATENT DOCUMENTS

| | | | |
|---|---|---|---|
| 205683 | 9/1939 | Switzerland | 271/129 |
| 2037261 | 7/1980 | United Kingdom | 271/160 |

*Primary Examiner*—Richard A. Schacher

*Attorney, Agent, or Firm*—Laff, Whitesel, Conte & Saret

[57] ABSTRACT

In a combination document feed system and document removal assembly associated with the document feed system for removing documents one at a time from a stack of documents disposed in the document feed system and feeding each document into a document transport system: comprising a document removal assembly for providing a substantially elongated contact surface between the document removal assembly and a lead document in the stack of documents, the contact surface adapted to alternately contact the lead document and advance the lead document from the document feed system to the document transport system. The document feed system includes belts for advancing the stack of documents toward a document removal assembly, including a back plate adapted to provide a compressive force to the rear of the stack of documents. The back plate is driven at the same speed of travel as the belts advance the stack of documents, and applies a progressively decreasing compressive force to the stack of documents as the stack of documents decreases in size.

1 Claim, 2 Drawing Sheets

MECHANICAL DOCUMENT FEED APPARATUS

The present invention relates generally to a document feed apparatus, and in particular to a feed mechanism for efficiently advancing documents, one at a time, from a horizontally disposed stack at a feeder station to a document transport station, and including a back plate drive mechanism which applies a progressively decreasing compressive force to the stack of documents as the stack of documents decreases in size.

BACKGROUND OF THE INVENTION

The conduct of business today requires the generation, handling, and processing of vast quantities of documents. The information on many of these documents must be read and understood, and then processed for further action depending upon the information on the document. By way of example, a banking check may have to be read and processed further to properly debit the account of the payee. Or, the address on a mailing envelope, including a zip code, may have to be read before the envelope is forwarded to its proper bin for distribution. Various automatic reading apparatus have been developed, including bar code reading equipment, magnetic-ink character reading devices, optical scanners, and the like, to increase the speed at which documents are processed. As the procedures related to reading and handling of documents have decreased the time necessary to interpret documents, the speed at which such documents can be passed through document handling apparatus has increased. Document handling apparatus has been developed to automatically and rapidly transmit documents, one at a time, from a storage station, through a transport station, and to a further processing station, for example, a document indicia reading station.

Some presently available document handling apparatus of the type referred to herein utilize document feed systems comprising intermittently driven roller devices at the end of a spring loaded horizontally disposed stack of documents, for example, to feed documents, preferably one at a time, from the end of the stack to the next work or processing station. Since many of the documents in the stack, such as checks, envelopes, or the like, may be of different sizes or paper quality, and have different effective coefficients of friction between adjacent pairs of documents, it is often difficult to ensure the feeding of one document at a time from the stack. Part of this problem is caused by the fact that certain stack feed mechanisms do not provide an efficient means for moving the stack as a unit thus improving the frictional force with which the feed roller can drive the document out of the stack.

In addition, currently available feed tray mechanisms of the type described do not provide a document feed station wherein a large stack of documents is fed in a feed tray by a system of underlying belts at a constant speed towards the feed roller, with a substantial force applied to the rear of the larger stack to move the documents forward in the feed tray, and thereafter progressively decreasing this force as the size of the stack of documents changes. If a force is not constantly applied to the back support plate urging the documents forward, a gap forms between adjacent documents, thereby disabling the feed roller mechanism disposed in the front plate of the feed tray.

An object of the present invention is to provide a document feed drive mechanism, which moves the feeder stack substantially as a unit, with a substantially increased surface area, whereby the frictional contact between the feed drive mechanism and the documents is increased.

Another object of the present invention is to provide a feed mechanism for moving a lengthy stack of documents vertically aligned at a feed station, wherein the feed mechanism maintains an initial substantial force on the rear of the lengthy stack of documents and then progressively decreases the force on the stack as the size of the stack decreases to prevent gaps from forming between documents as they move forward in the feed station.

A further object of the present invention is to provide a feed mechanism for advancing documents in a lengthy stack of documents vertically aligned at a feed station, wherein the feed station includes a belt system underlying the document stack which drives the documents forward to a document removal assembly at a constant speed, and further includes a movable back-up plate which advances at the same speed as the movement of the belt system, while at the same time provides a variable compressive force to the stack of documents remaining in the feed station.

SUMMARY OF THE INVENTION

A document advancing mechanism is operatively connected to a document feed system for advancing a stack of documents in a bin toward a document removal assembly. The document advancing device includes a back plate which applies a progressively decreasing compressive force to the rear of a large stack of documents as documents are removed from the front, and the stack reduces in size, while simultaneously advancing at the same speed of travel as the stack of documents is advanced toward the document removal assembly.

DESCRIPTION OF THE PREFERRED EMBODIMENT

Figure 1:
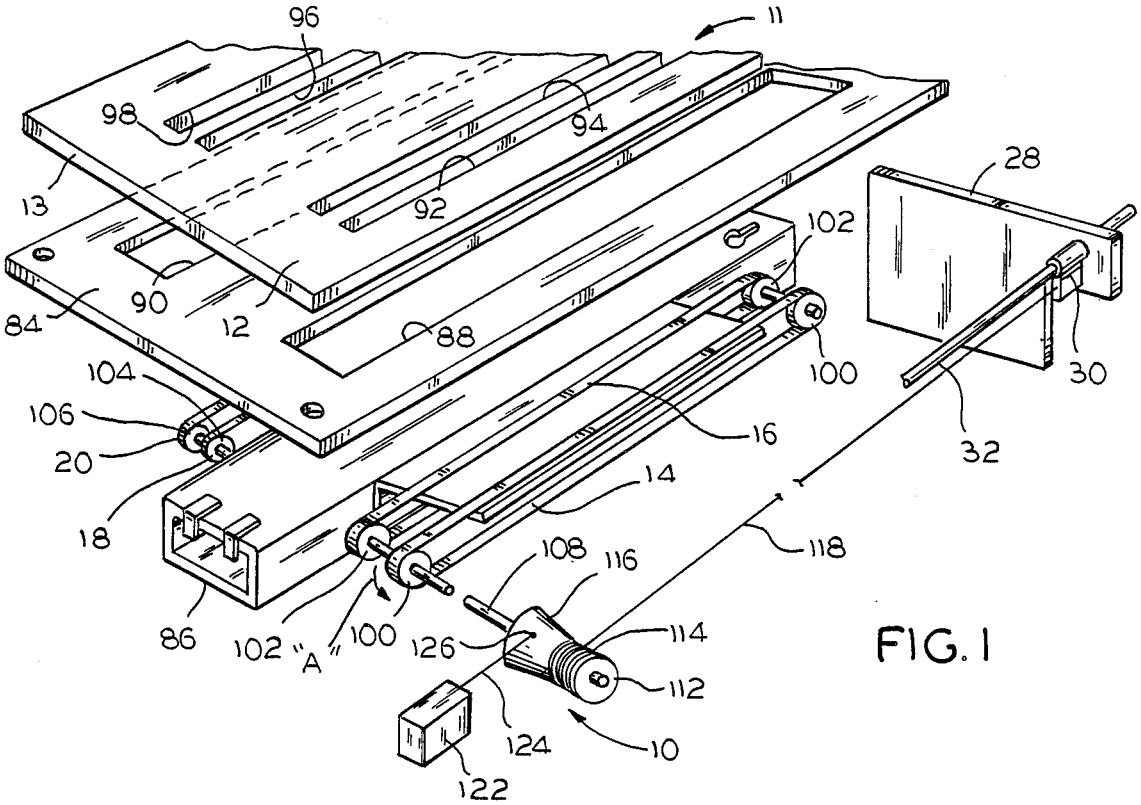
FIG. 1 is an exploded perspective view of a document feed tray forming part of the present invention, showing in particular the document advancing mechanism and the constant force spring assembly which controls movement of the document back plate as documents are serially removed from the feed tray.

Referring to FIG. 1, the document feed system forming part of the preferred embodiment of the present invention includes a slotted feed tray 11 having a bottom plate 12 along which a plurality of running belts 14, 16, 18 and 20 extend, each belt moving in the direction shown by the arrow "A". Documents such as envelopes, checks, or the like, (not shown) are each arranged transversely in a horizontally extending stack. Each document stands vertically in tray 11 with its bottom edge resting on bottom plate 12 and belts 14, 16, 18, 20, and is urged toward the left hand end 13 of plate 12 by a back plate 28 which is resiliently or otherwise driven forward as documents are sequentially removed at end 13 from feed tray 11.

As illustrated schematically in FIG. 1, back plate 28 is connected to a bracket 30 which slides along a rod-like member 32, and which plate moves forward to the left as viewed in FIG. 1 to advance the documents towards end 13 of plate 12 under the influence of a constant force mechanism 10 and which will be discussed in further detail below. Back plate 28 and its associated drive mechanism are adapted to provide a continual force to the stack of documents as the documents advance in feed tray 11. In the preferred embodiment, if the stack of documents is relatively long, the force applied by back plate 28 is initially high, and then decreases as the stack of documents 24 becomes shorter. Also, back plate 28 advances along feed tray 11 at the same speed as belts 14–20, thus providing a continual and uniform feed of documents to the forward end 13 of feed tray 11, where a document removal assembly generally designated by the numeral is disposed at the forward end 13 of feed tray 11.

FIGS. 1–5 illustrate the construction of document feed tray 11 which includes a constant force spring assembly 10 connected to back plate 28 to maintain a continual force upon the rear of a stack of documents to thereby prevent gap from forming between individual documents, which gaps would prevent the steady flow of documents from feed tray 11. A continual horizontally applied force must be applied to the stack of documents (FIG. 1) to consistently press the lead document into engagement with the document removal system. If a continual force is not applied, and gaps in the stack are allowed to occur, ultimately the lead document will not be pressed against the removal system, thereby disabling the feed mechanism and preventing the proper feeding of the lead document from feed tray 11. The preferred embodiment of the present invention, as illustrated in FIGS. 1–5, provides a back plate 28 pressing against a stack of documents (not shown for clarity in illustration) in feed tray 11 to which a continual and progressively decreasing force is applied through back plate 28, and also provides a conveyor belt system to move the documents toward document removal assembly (not shown) at a consistent rate of speed.

Referring to FIG. 1, wherein like numbers are used to designate like elements in other figures, feed tray 11 comprises a smooth surfaced, relatively thin bottom plate 12, which is made of stainless steel or other suitable material which offers a low coefficient of friction to the bottom edge of each document 22 moving across the bottom plate. Bottom plate 12 is supported by a thicker plate 84, made of aluminum or other suitable material, which provides strength and rigidity to the feed tray 11. A rectangular tubular extrusion 86 is connected to the underside of plate 84 along a central axis to add further support to the feed tray, and to support the document advancing mechanisms associated with the feed tray.

Plate 84 of feed tray 11 includes a pair of longitudinally extending relatively wide slots 88, 90. The portions of bottom plate 12 directly above slots 88 and 90 comprise narrower longitudinally extending slots 92, 94 and 96, 98.

Figure 2:
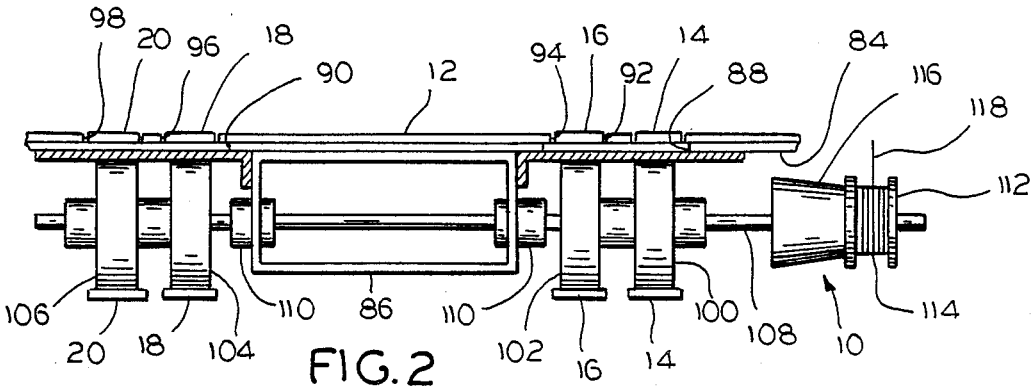
FIG. 2 is an end elevation view in partial section of the belt drive forming part of the document advancing mechanism illustrated in FIG. 1.

The mechanism of feed tray 11 which advances documents 22 towards document removal assembly 34 (FIG. 1) includes four belts 14, 16, 18, 20 mounted on spaced pairs of pulleys 100, 102, 104 and 106 (FIGS. 1 and 2). The front pulley of each pulley pair is mounted on a drive shaft 108 which is suitably mounted for rotation through tubular extrusion 86 of feed tray 11 by means of bushings or bearings 110 as seen in FIG. 2. In the preferred embodiment, all pulleys 100, 102, 104 and 106 are the same diameter. The upper rims of belts 14, 16, 18, 20 extend through slots 88 and 90 in plate 84, and through slots 92, 94, 96 and 98 in bottom plate 12, as seen in FIG. 2. Belts 14, 16, 18, 20 are thick enough to extend slightly higher than the plane of bottom plate 12, so that the bottom edges of each document in a stack of documents 22 standing on edge in feed tray 11 will rest on the upper runs of the belts. As the belts are driven in the direction of the arrows A in FIG. 1 as will be explained, the stack of documents 24 is advanced toward document removal assembly.

The power for driving belts 14, 16, 18, 20 is supplied by constant force spring assembly 10 (FIGS. 1–3), which is connected to, and simultaneously controls the movement of back plate 28 as it moves along rod 32 and advances towards front end 13 of plate 12 (FIG. 1). To this end, a power spool 112 is attached by means of a one way clutch to the free end of drive shaft 108. Power spool 112 comprises a constant diameter portion 114 and a conical-shaped variable diameter portion 116. A wire or other suitable linkage element 118 is wrapped at one end around constant diameter portion 114 of spool 112, while the other end of wire 118 is attached to bracket 30 forming part of back plate 28.

A constant force spring motor 122 is supported in a fixed position on the structure that is supporting feed tray 11. Spring motor 122 is a standard mechanism available today which comprises a spring element 124 extending from the spring motor housing, which spring element provides a constant force to a mechanism it is connected to regardless of the change in length of the spring in the motor 122 as the spring is wound on or unwound from a central core (not shown). One end of spring element 124 is fastened to a point 126 on the surface of the variable diameter portion 116 of power spool 112, as shown in FIG. 1.

Figure 3:
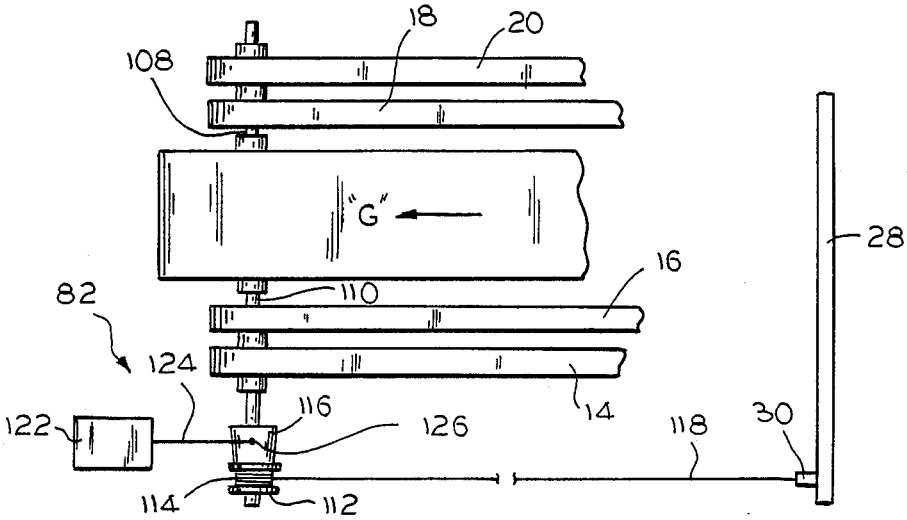
FIG. 3 is a partial plan view of the belt drive and constant force spring assembly illustrated in FIG. 1, omitting the slotted support plates for clarity in illustration.

In operation of the embodiment of feed tray 11 illustrated in FIGS. 1–3, back plate 28 is manually moved to its initial position at the rear of feed tray 11, which is at the opposite end of the feed tray from end 13 of plate 12. As back plate 28 is moved rearward, wire 118 unwinds from power spool 112, causing the spool to rotate. Simultaneously, constant spring motor 122 is wound, or loaded, as spring element 124 is withdrawn from spring motor 122 and wound around variable diameter portion 116 of spool 112 as spool 112 rotates under the influence of wire 118. A one-way clutch provided between power spool 112 and drive shaft 108 allows spool 112 to rotate during this "loading" operation without rotating shaft 108.

After back plate 28 has been moved to its rearward position, and power spool 112 and constant force spring motor 112 has been "loaded" as described above, a stack of documents (not shown) is placed in feed tray 11 with the bottom edge of each document resting on the upper runs of belts 14, 16, 18 and 20. The lead document is placed against a face plate, and back plate 28 is allowed to move forward until it is in abutment with the last document in the stack. As back plate 28 moves forward, and power spool 112 rotates under the influence of spring motor 122, the one way clutch between drive shaft 108 and spool 112 causes shaft 108 to rotate and advance belts 14, 16, 18, 20 slightly in the direction of arrow "A" (FIG. 1). However, during this loading operation, the bottoms of the documents are manually held so that the bottoms of the documents slide along the top of the belts 14, 16, 18, 20.

After feed tray 11 has been properly loaded with documents, the document processing apparatus with which feed tray 11 is associated is actuated. As the documents are removed from the stack one at a time by the document processing apparatus, back plate 28 moves forward under the influence of constant force spring motor 122 and wire 118. Simultaneously, drive shaft 108 rotates and drives belts 14, 16, 18, 20 in the direction indicated by arrows G in FIG. 3. The continual pressure on the stack of documents by back plate 28 maintains the advance of documents in the feed tray, along with belts 14, 16, 18, 20, and prevents the formation of gaps between the documents 22. Thus, a continual document feed progression to a document removal assembly is ensured.

When feed tray 11 is adapted to hold and feed lengthy stacks of documents, approximately two to three feet in length in certain instances, it is desireable to provide a larger force to back plate 28 when the feeding operation commences, since more documents have to be moved and the inertia of the documents is greater. In this situation, it is desireable that back plate 28 initially provide a substantial force to the stack of documents, and that this force is then progressively reduced as the stack becomes shorter as documents are removed from the stack. This variable force is supplied by spring element 124 applying its motive force to back plate 28 by means of the variable diameter portion 116 of power spool 112. When spring element 124 winds around variable diameter portion 116 of spool 112 during the "loading" operation described above, spring element 124 winds from the smallest diameter end of the variable diameter portion 116 to the largest diameter end of the spool. Thus, during feeding operations of feed tray 11, spring element 124 unwinds from the larger diameter end to the smaller diameter end of spool 112. Therefore, the force applied to wire 118 is maximum when back up plate 28 is in its rear most position, and stack of documents 24 is largest. As the stack decreases in size, spring element 124 progressively moves to the smaller diameter end of portion 116, whereby the force on wire 118 decreases the force on wire 118 proportional to the radial distance between the central axis of spool 112 and the point where spring element 124 contacts variable portion 116 of spool 112.

Constant force spring motor 122 rotates spool 112 and drive shaft 108 at a constant speed throughout the document feeding operation described above, even though a variable force is applied to back up plate 28. This is important in maintaining uniformity of operation of the entire document feed system, document removal assembly, and document transport system with which it is associated.

The preferred embodiment of the feed tray 11 illustrated in FIGS. 1–3 provides for horizontal transport of documents by means of the same constant force spring motor 122 which, through power spool 112, provides a variable force-constant speed drive for back plate 28 and for the horizontal transport belts 14, 16, 18, 20. A feature of the present invention is that the speed of belts 14, 16, 18, 20 and the degree of force applied to back up plate 28 can be variably controlled by changing the diameters of the various portions of power spool 112, or the diameters of pulley pairs 100, 102, 104 and 106. The combined movement of belts 14, 16, 18 and 20 and back plate 28 apply a continual compressive force to the stack of documents to eliminate the possibility of gaps forming between the documents.

Figure 4:
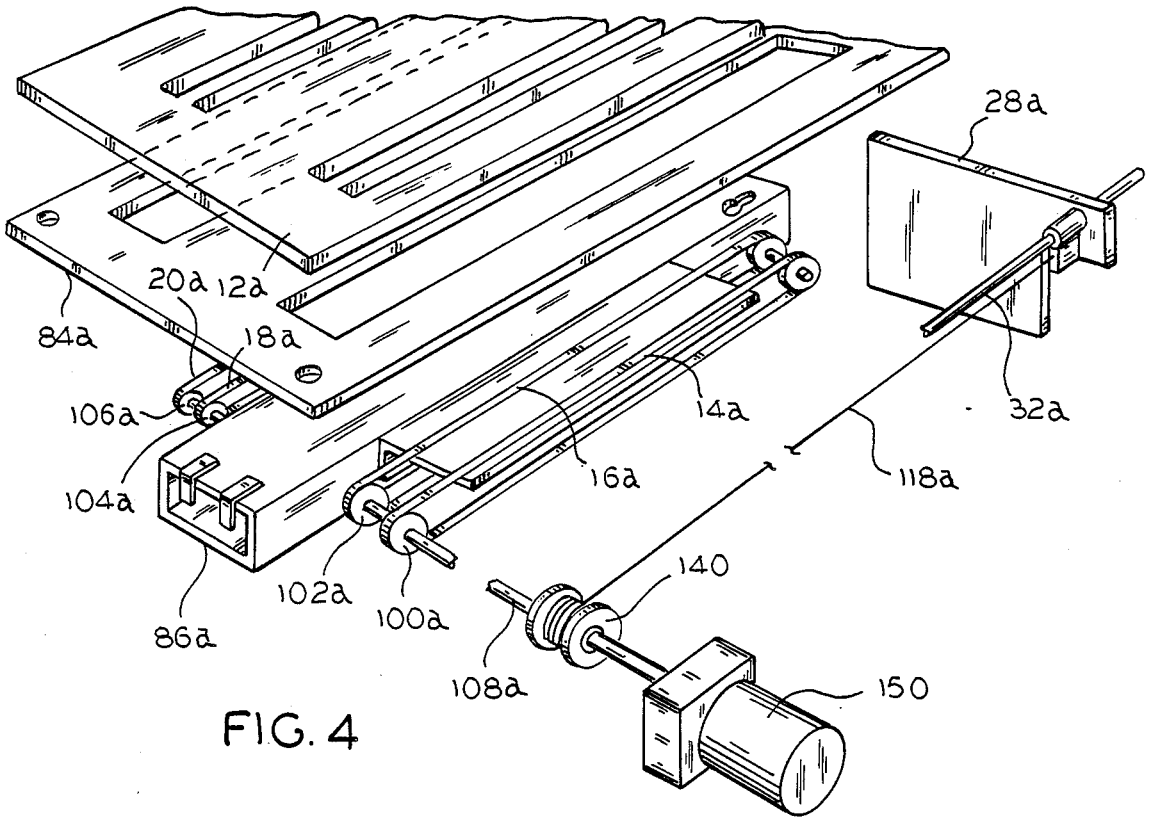
FIG. 4 is an exploded perspective view of a document feed tray similar to FIG. 1 except for a variation in the spring tension means utilized for the back plate assembly.
Figure 5:
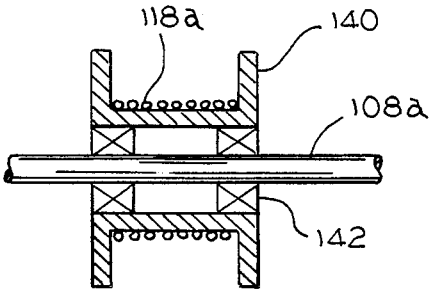
FIG. 5 is a cross-sectional elevation of the one-way clutch being utilized in FIG. 4.

FIG. 4 is a modification to the device shown in FIG. 1 wherein similar parts are designated by similar numerals plus the addition of suffix "a" in this modification the constant spring tension means 122 which was found in assembly 10 is replaced by a constant speed motor 150 having substantially greater strength than the spring mechanism 122 and a one-way clutch carrying pulley 140 whereby when the plate **28*a* is moved to the back of the feed tray bottom plate 12*a* (i.e. to the right in FIG. 4) the cable 118*a* causes the pulley 140 to rotate in a clockwise direction, as seen in FIG. 4, and with the clutch mechanism 142 permitting the movement of plate 28*a* without affecting the continued rotation of the axle 108*a* and the pulleys 100*a*–106*a* carried thereon to move the belts 14*a*–20*a*. When pressure is released from the plate 28*a* after being moved to the back of tray 12*a* it too is then moved forward (i.e. to the left in FIG. 4) by the clutch 142 acting on the pulley 140 to rewind the cable 118*a* and move plate 28*a* along the rod support 32*a***.

While a preferred embodiment of the invention has been illustrated and described herein, various changes and modifications may be made therein without departing from the spirit of the invention as defined by the scope of the appended claims.

I claim:

1. In a document feed system including means for advancing a stack of documents arrayed in a feed tray towards a document removal assembly disposed at one end of said feed tray for removing documents one at a time from said stack of documents in said feed tray, said means for advancing said stack of documents including belt means disposed at the bottom of said feed tray and in contact with said stack of documents, said belt means extending around first and second pulley means, one of said pulley means being rotated by a shaft, spool means connected to said shaft, said spool means having a constant diameter section and a variable diameter section, back plate means movably supported by said feed tray means for movement along said feed tray mean and disposed in abutting relation to the last document in said stack of documents to apply a compressive force to said stack of documents, linkage means connecting said back plate means to said constant diameter portion of said spool means, said variable diameter section of said spool means being connected to a constant force power source which applies a variable pressure force to said back plate means through said variable diameter section of said spool means and said linkage means as said back plate advances in said feed tray means at a constant rate of speed and said constant force power source drives said belt means at said constant rate of speed, whereby said back plate and said belt means advance at the same rate of speed toward said document removal assembly as the pressure force applied by said back plate to said stack of documents decreases progressively as said stack of documents becomes shorter.

* * * * *

UNITED STATES PATENT AND TRADEMARK OFFICE

CERTIFICATE OF CORRECTION

PATENT NO. : 4,928,952

DATED : May 29, 1990

INVENTOR(S) : Eduard Svyatsky

It is certified that error appears in the above-indentified patent and that said Letters Patent is hereby corrected as shown below:

Column 6, line 50, delete "feed tray mean" and insert --feed tray means--.

Signed and Sealed this

Thirteenth Day of May, 1997

*Attest:*

*Attesting Officer*

BRUCE LEHMAN

*Commissioner of Patents and Trademarks*